United States Patent [19]

Schippers

[11] 3,987,136

[45] Oct. 19, 1976

[54] PROCESS FOR THE PRODUCTION OF A SYNTHETIC FIBER CORD

[75] Inventor: Heinz Schippers, Remscheid, Germany

[73] Assignee: Barmag Barmer Maschinenfabrik Aktiengesellschaft, Wuppertal, Germany

[22] Filed: Nov. 12, 1973

[21] Appl. No.: 415,112

[30] Foreign Application Priority Data

Nov. 10, 1972 Germany ..... 2254998

[52] U.S. Cl. ..... 264/103; 28/72 R; 57/157 S; 264/210 F; 264/290 T; 264/290 N

[51] Int. Cl.[2] ..... D01D 5/12

[58] Field of Search ..... 264/176 F, 210 F, 290 T; 28/72; 57/157 S

[56] References Cited

UNITED STATES PATENTS

| | | | |
|---|---|---|---|
| 3,216,187 | 4/1965 | Chantry et al. | 264/290 T |
| 3,305,911 | 2/1967 | Chapman et al. | 264/168 |
| 3,513,110 | 5/1970 | Noether | 264/210 F |
| 3,707,593 | 12/1972 | Fukada et al. | 264/176 F |
| 3,715,421 | 2/1973 | Martin et al. | 264/210 F |
| 3,772,872 | 11/1973 | Piazza et al. | 57/140 R |
| 3,797,221 | 3/1974 | Ikeda et al. | 57/140 R |
| 3,816,992 | 6/1974 | Frankfort et al. | 57/140 R |

FOREIGN PATENTS OR APPLICATIONS

| | | | |
|---|---|---|---|
| 45-1932 | 1/1970 | Japan | 264/210 |

*Primary Examiner*—Jay H. Woo

*Attorney, Agent, or Firm*—Johnston, Keil, Thompson & Shurtleff

[57] ABSTRACT

Production of cord fabrics by continuous, melt spun polyamide or polyester filaments which are plied and twisted and then are formed into a tire cord layer or fabric consisting essentially of planar, parallel, longitudinal cord yarns with or without weft yarn interweaving, characterized by multifilament melt spinning with a predraw at more than 3000 meters/minute, cooling, plying and twisting into cord yarns without further stretching, and then residual stretching of less than 2.4:1 at 50°–130° C of the filaments before or after incorporation into the web or fabric.

10 Claims, 9 Drawing Figures

PROCESS FOR THE PRODUCTION OF A SYNTHETIC FIBER CORD

The invention is concerned with a process for the production of a synthetic filament in which continuous filaments which have been spun in the melt spinning process are processed into cord yarns by twisting. The cord yarns are laid together to form a cord layer composed essentially of planar, parallel, cord yarns with or without interweaving of weft threads, i.e., the transverse or shuttle threads, followed by further processing.

Cord yarns have been used as basic materials in transmission belts, conveyer belts, or similar bands, straps, or the like and especially in tires. The production of cord yarns and synthetic fibers can be carried out according to various methods wherein the procedures, such as spinning of the synthetic polymer filaments, stretching, plying, twisting, fabric production, after-stretching, fixation and treatment with agents to achieve better adhesion of rubber to the fabric, are varied and can be adapted to the special properties and requirements of the synthetic raw materials and/or the yarns. In the production of cord yarns from polyamides or polyesters, it is known for example to spin multi-filament yarn in the melt spinning process and to take up this yarn on a spinning bobbin (Fourne, Synthetische Fasern 1964, p. 881 ff.). For the purpose of stretching, the spinning bobbin is placed on a draw twisting machine so that each filament strand in this process step has its final stretch (i.e., is completely stretched), for example, in a stretch or draw ratio of 1:5.2 or 1:6.4, and contains a slight protective twist of conventionally 20 to 180 turns per running meter of yarn length. It also is known that one can continuously spin the filamentary strands, stretch them in a draw winding machine, and then spool them in untwisted form.

A process is also known in which the stretching process is subdivided for the spun filaments. In this case,, the freshly spun filaments are pre-stretched in a first stretching zone in a ratio of approximately 1:3 and then spooled. The wound, prestretched filaments are then drawn off overhead, and the filamentary strands are stretched to completion on a heavy-duty heating and draw twist machine in a second stretching zone by means of a heated pin and heating plate in a draw ratio of about 1:5.5, each filament then being fixed and finally wound up by means of a ring twist spindle (Textil-Praxis 1958, p. 1206).

In all processes for the production of cord yarns there follows these further process steps: the pre-twisting, plying and final twisting of the multi-filament threads into the cord ply yarns (Fourne, Synthetische Fasern, 1964, pp. 883–887).

The plied and twisted cord threads are led together in a subsequent procedure to form a planar bundle or layer of parallel threads, wherein the threads can be interlaced or interwoven for mutual connection by means of weft or shuttle threads of relatively low strength introduced at regular intervals. It is of particular importance for the further use of the fabric product to subject the cord yarns prior to vulcanization to an additional heat stretching and heat fixing treatment (Textil Praxis 1970, pp. 270–274). The so-called dipping process is used in connection with the after-stretching, wherein the surface of the cord yarns is made more capable of adhesion to rubber through an impregnation treatment, e.g., before it is coated in a calender with the rubber mixture. The after-stretch amounts to approximately 10% and the resulting shrinkage during the heat fixing is approximately 1 to 2.5%.

It is the purpose of this after-stretching to adjust the elongation characteristic of the cord to that of the rubber composition and to reduce the shrinkage capacity and the heat-induced elongation of the cord yarns (Gummi, Asbest, Kunststoffe 24 (1971), No. 5, pp. 480–484 and 492). The after-stretching and heat-fixing takes place in an after-stretching machine through which the cord yarns are individually conducted or in a fabric-stretching apparatus through which the cord fabric is conducted.

It is an object of the invention to simplify the process for the production of cord yarns from the spinning of multi-filament synthetic filaments up to the after-stretching of the cord ply yarns or the cord fabric while maintaining and improving the properties of the finished product.

It is particularly an object of the invention to reduce the stretching process which is carried out at least twice according to known methods to a single stretching process. According to the invention, a process is recommended for this purpose in which the multi-filament strands, are subjected to a pre-orientation, resulting from a take-off speed of more than 3.000 m/min. These pre-orientated strands or filaments are cooled and without further stretching are plied and twisted into a cord ply yarn and only then are subjected to a residual stretching of less than 2.4:1. Insofar as the planar parallel cord layers are to be worked into webs or fabrics in this process, it is advisable and preferred that the web or fabric formation take place before the residual stretching.

The process of the invention for the production of cord yarn from synthetic fibers, its additional embodiments and its advantages are illustrated with the aid of the accompanying drawings, wherein.

Figure 1:
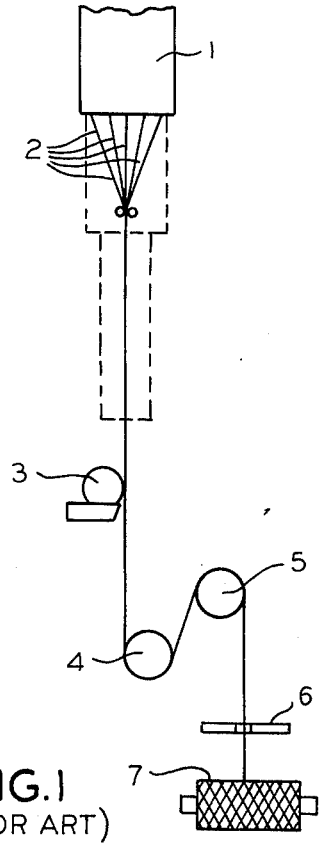
FIG. 1 (PRIOR ART)
FIG. 1 is a schematic view of production of spinning and bobbin winding according to a conventional process.

According to known discontinuous processes for the production of cord yarns, for example, a polyester cord thread of 840 denier composed of 140 individual filaments 2, (FIGS. 1 and 2), the melt is extruded from a spinning nozzle with 140 orifices by means of an extruder and spinning pump 1. The collected filaments are moistened in a wetting device 3 by a spinning preparation. These collected strands are drawn off over the godets 4 and 5 and wound onto the spinning bobbin 7 by means of a thread traversing guide 6 at a constant linear velocity of, for example, 800 m/min.

Figure 2:
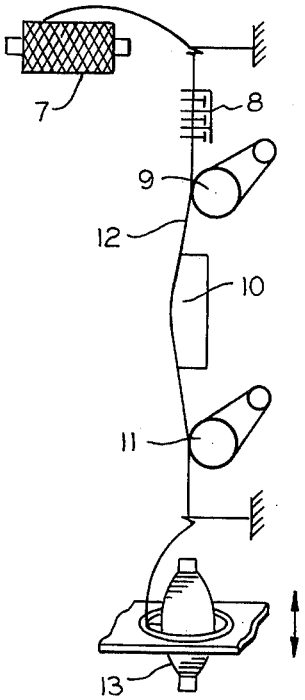
FIG. 2 (PRIOR ART)
FIG. 2 is a schematic view of the stretching and twist-winding of the spun and wound yarn according to a conventional process.

According to FIG. 2 the spinning bobbin 7 is placed on a heavy-duty heating and draw-twist machine. This consists essentially of the thread brake 8, the heated godet 9 with temperatures for example of 70 to 90° C., the thread being wound several times around the godet, a further heating plate 10 as well as the draw godet 11 and the ring twister 13. The thread is stretched or drawn with a total stretch ratio of more than 5.4:1. The stretch point or necking down point 12 thereby forms in known manner and is stabilized in the neighborhood of the heated godet 9. With regard to further details and modifications of these process steps, reference is made to the state of the art.

The production of the cord ply yarn follows directly after production and stretching of the cord filaments and takes place for example in two stages. In the first stage (FIG. 4) the cord filaments are twisted on a cord twist-plying machine by drawing them off double-twist twisting spindles 17. Two or three pre-twisted cord yarns from spindles 17 are wound onto the flanged bobbin 19 by means of a thread control device and thread length counter 18, while maintaining a constant thread length and tension. In the second stage (FIG. 5), the twisted and plied cord yarn is after-twisted, for example, again by means of a double twist twisting spindle 20, and wound onto a cylindrical cross-wound spool 21. Further details and modifications are given for example in Knur, Textil-Praxis 1970, pp. 270 ff. The number of twist turns both in the pre-twist and also in the after-twist depends upon the technical demands of the cord fabric and upon the quality of the cord required thereby. The double-twist twisting spindles 17, 20 apply to the cord filaments and the plied cord yarn a two-for-one twist, i.e., a double twist per revolution of the double twist spindle.

Figure 6:
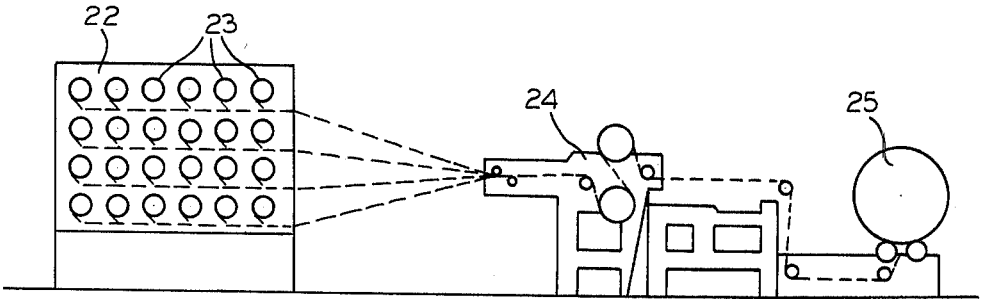
FIG. 6 is a schematic view of the production of a tire cord fabric.

In the schematic illustration according to FIG. 6, the production of the cord fabric or web is shown. The cord yarn is drawn off from the feed spools 23 mounted on the run-off creels 22 under an equally maintained tension as a warp thread band and is fabricated in the loom 24 into the cord fabric or web by means of cross or weft threads of slight strength, for example, light cotton threads, in order to interconnect the warp yarns at regular intervals with each other. The cord fabric is then taken up by a winding frame as the fabric winding or roll 25.

Figure 7:
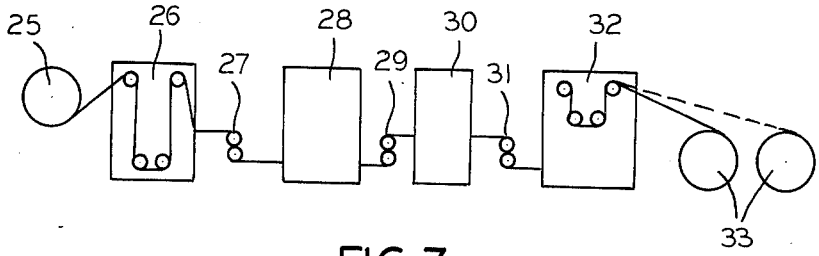
FIG. 7 is a schematic view of a cord fabric stretching and fixing apparatus.
Figure 8:
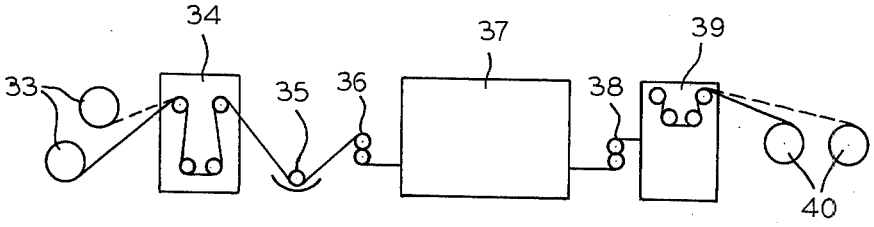
FIG. 8 is a schematic view of the impregnation segment of the fabric stretching equipment.

In FIGS. 7 and 8, there is illustrated schematically a cord fabric stretching and impregnation apparatus with the fabric winding or roll 25, fabric feed reserve or storage unit 26, the feed rolls 27 of the stretching means, heating chamber 28 and the set of draw rolls 29 of the stretching means. Following are a second heating chamber 30, the conveying or tension rolls 31, a fabric run-off reserve or unit 32 and the cord web or fabric windings or rolls 33 which fabrics have been after-stretched. As much as possible, the impregnation process of FIG. 8 is joined continuously with the thermal treatment of the web.

The impregnation apparatus according to FIG. 8 consists of the after-stretched cord web winding 33, the fabric feed reserve unit 34, the impregnation trough or tank 35, where the fabric sheet is impregnated with a suitable dipping agent such as for example latex coating solutions or resorcinol-formaldehyde resins in the presence of finely disperced silica, e.g.., silicic acid, the conveying rolls 36, the drying chamber 37, the conveying or tension rolls 38, the fabric run-off reserve unit 39 and the fabric winder or spooling device 40. For further details and modifications of after-stretching and impregnation apparatus, compare Krückels *Imprägnier-, Heissverstreck- und Heissfixieranlagen für Rayon-Polyamid und Polyester-Reifenkord* in *Gummi, Asbest, Kunststoffe* 1971, pages 480 ff.

Figure 3:
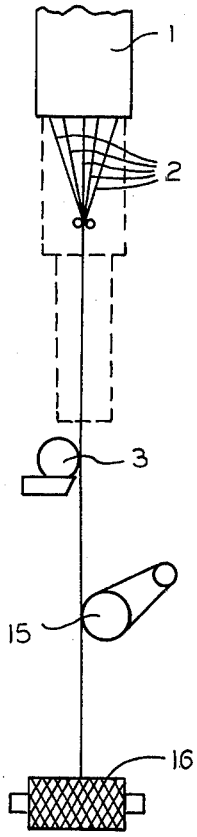
FIG. 3 is a schematic view of the first process step of the subject invention.

According to the process of the invention, which is set forth schematically in FIGS. 3, 4, 5 and 6 as well as 7 and 8, multi-filament synthetic filaments suitable for the production of cord, especially nylon-6,6 and polyester yarns of conventional filament number and yarn size (titer), are spun in a first process step - illustrated in FIG. 3. In this first step, the yarn 2 is drawn off from the spinning unit 1 with cooling and application of a suitable preparation 3 by means of the godet 15 at a speed of more than 3,000 m/min. and then wound onto the bobbin 16. The godet 15 may be omitted so that the filament strands are drawn off directly by the bobbin or winding spool 16.

For polyester yarn, the drawing off speed should not lie below 3,000 m/min. It has been found that polyester filament which has been drawn off at more than 3,000 m/min. does not form during the stretching any flow zone with a distinct or well-defined necking down point whereby the stretching of the polyester filaments can take place without using a stretching pin or other device, which is otherwise necessary in the normally spun, slower drawn polyester for the localization or specific fixation of the necking down point (U.S. Pat. No. 2,533,013). The latter is technically difficult to achieve with cord layers or cord fabric sheets.

For polyamide yarn, e.g., nylon-6,6 yarn, which is a preferred material for tire cords, there preferably are maintained drawing off speeds of more than 3,500 m/min. in the spinning stage according to FIG. 3, because drawing off speeds between approximately 2,000 and 3,500 m/min. lead to difficulties in the spinning and winding process.

Figure 4:
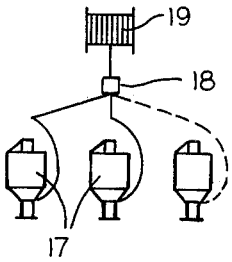
FIG. 4 is a schematic view of the pre-twisting and simultaneous plying of this invention's filaments by the double twist twisting process.
Figure 5:
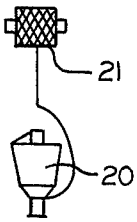
FIG. 5 is a schematic view of the after-twisting of the pre-twisted filaments by the double twist twisting process.

Then, as illustrated in FIGS. 4 and 5, the yarns spun in this manner are pre-twisted, plied and after-twisted into the completed cord ply yarn or thread. Herein, the speed of the twist spindle and the thread speed are adjusted with respect to each other in such a manner that the pre-twisted yarn or the completely twisted cord ply yarn then exhibits the predetermined number of twist turns per meter of thread length (T/m) when they are stretched. This means that a cord yarn, which should exhibit a pre-twist of 600 T/m and which is stretched after the twisting process with a draw ratio of 1.6:1 and is then heat set with a permissible shrinkage of 3%, contains in the pre-twist according to FIG. 4 a twist of $600 \times (1.6 - 0.03) = 600 \times 1.57 = 942$ T/m. This is likewise true of the final twist of the plied and after-twisted cord threads according to FIG. 5. Too high a twisting can be avoided by increasing the draw off speed in the spinning zone (FIG. 3) and the resulting reduction of the stretch ratio caused thereby.

The completely twisted cord yarns, preferably before the stretching, are laid together into groups or bands of planar parallel yarns, i.e., in the form of parallel warp threads lying in a single plane, and preferably in many instances made into a cord fabric or web by insertion of the weft threads by the loom of FIG. 6.

The stretching of this fabric or web takes place on a web stretching machine according to FIG. 7 in the stretching chamber 28 between feed rolls 27 and draw rolls 29. It should be noted that stretching can take place equally well on a web or warp band stretching apparatus or by individual stretching of the cord yarns. The stretching or draw ratio amounts to less than 2.4:1. In particular, the draw ratio to be selected is primarily dependent upon the chosen drawing off speed in the spinning stage (FIG. 3) and also upon the stretching temperature. The regions or areas in which the draw ratio may lie are shown in the shaded parts of the diagram of FIG. 9, especially for polyester (PES) and nylon-6,6 (PA 6.6) cord yarns or cord fabrics. It has also been found in this process, that other spinning parameters such as the diameter of the spinning orifices, the extrusion velocity in or directly after the spinning nozzle, the individual filament size, etc., to provide a range of yarn size commonly used for cord production, do not have any exact influence and are therefor of little technical importance. It is possible to change the illustrated relationship between drawing off velocity and draw ratio by varying the cooling conditions in the spinning zone and especially by a heat treatment of the fibrous strands so as to reduce the preorientation and thereby the residual stretch.

The selection of the most appropriate draw ratio and the correct stretching temperature is especially important for the quality of the cord yarn. By means of these process conditions, there is especially influenced in a decisive manner not only the strength and elongation properties of the cord but also the special shrinkage properties which are very important for tire cords (usually defined as hot air shrinkage or boiling shrinkage values). The stretching can take place in a special fluid medium, e.g., water, steam or the like.

As illustrated on FIG. 7, the heat setting in the second heating chamber 30 is joined directly and continuously with the stretching step. This fixation is preferably done under the influence of heat with or without tension. The heat setting treatment serves above all for lowering the shrinkage tendency to an extent appropriate for the technical use of the cord yarn. However, the strength and elongation properties are also influenced by this choice of suitable thermal or heat fixation conditions.

For the heat fixation, the speed of the conveying rolls 31 in comparison to the draw rolls 29 may be set in such a manner that the tire cord threads shrink to a predetermined amount. This predetermined shrinkage is of great influence on the shrink capacity of the finished tire cords, i.e., expressed as hot air shrinkage or boiling shrinkage. The predetermined shrinkage is calculated according to the formula $$\frac{V_{29} - V_{31}}{V_{29}}$$

wherein $V$29 is the rotational peripheral velocity of the draw rolls 29 and $V$31 is the rotational peripheral velocity of the conveying rolls 31. Such a predetermined shrinkage or so-called pre-set shrinkage lies at about 0 to 15% or more. The pre-set shrinkage can be so large that the thread tension in the cord layer or warp band is practically zero.

As heat setting temperatures, one may employ the broadest temperature range required to achieve the desired cord properties. One limitation is of course determined by the softening point of the polymer. The heat setting temperatures and the pre-set shrinkage are adjusted to one another in the heat stabilizing zone 30 such that the desired cord shrinkage properties are achieved without any disadvantageous influence on the strength and elongation properties obtained in the stretching zone. Details of the heat setting process may be determined by simple testing in accordance with conventional practice in this art. (See for example Riggert, *Das Kontinuierliche Thermofixieren von Polyester-Endlosfaden* in *Chemiefasern,* 1969, pages 816 ff.). It is also possible to arrange before or after the heat stabilizing zone 30 a further controlled temperature zone suitable for carrying out a tension free heat treatment.

The advantage of the invention resides in the fact that the draw twist machine illustrated schematically in FIG. 2 or the draw winding machine otherwise used in its place can be omitted, and in this manner one can achieve a very considerable increase in the efficiency of cord production with reference to apparatus and operating costs. Furthermore, on account of the much higher output of the spinning apparatus according to FIG. 3, one can also achieve in this stage a further cost reduction of the apparatus and its operation.

Contrary to expectations, it has been proven that filaments spun by the process according to FIG. 3 are very suitable for twisting and for the production of the warp yarns of the cord web or fabric, i.e., without prior stretching. It has also been shown, in accordance with the invention, that the forces which are necessary for the stretching of the filaments drawn off according to FIG. 3 at speeds of more than 3,000 m/min. and then twisted, are smaller than the forces required for the production of synthetic fibers of the same material according to the conventional spinning and stretching procedure of FIGS. 1 and 2. Finally, it has been proven that the polyester filaments themselves, spun at drawing off velocities of more than 3,000 m/min., require no specific fixation of the stretch or necking down point in the stretching of the freshly spun filaments. These determinations in their entirety have made it possible to eliminate the previously conventional stretching processes for cord and especially tire cord, and by changing the entire production process hitherto existing to use the conventional web stretching apparatus already available in tire cord production instead of using the previously conventional draw twist or draw winding machines for stretching the tire cord yarns.

The preferred synthetic polymers for production of the filaments, yarns and cords of the invention herein are polyamides and polyesters. The preferred polyamide is nylon 6,6, the polyamide of adipic acid and hexamethylenediamine. Other nylons which may be used include nylon-6 (polycaprolactam). The symbol PA 6.6 in FIG. 9 means Nylon 6.6

The preferred polyester is polyethylene terephthalate.

Figure 9:
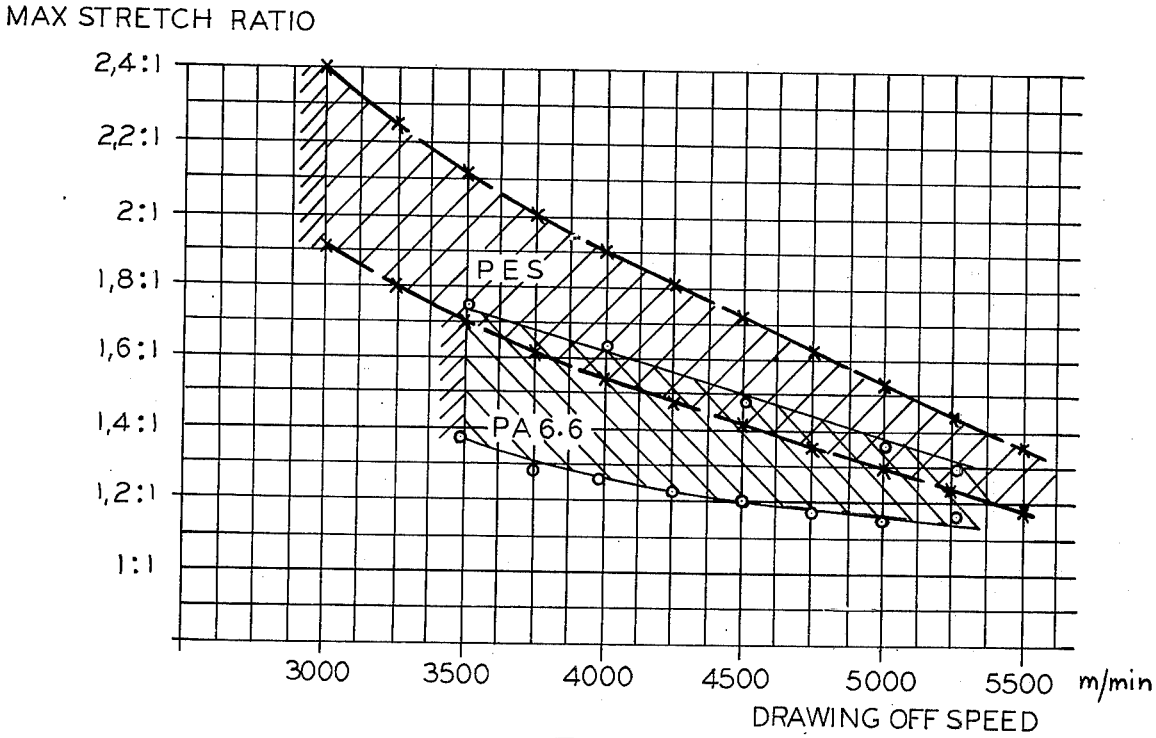
FIG. 9 is a graphic diagram showing the dependency of the stretching ratio upon the drawing off speed.

The symbol "PES" in FIG. 9 means polyethylene terephthalate.

The invention is hereby claimed as follows:

1. A process for the production of synthetic cord yarns, useful as cord webs or fabrics in tires and the like wherein continuous, melt-spun synthetic polymer filaments of nylon 6,6 or polyethyleneterephthalate are fabricated into cord yarns by plying and twisting of said filaments and the cord yarns are laid together with or without interweaving of weft threads in a cord layer consisting essentially of planar, parallel, cord yarns, the improvement which comprises subjecting the spun filaments of nylon 6,6 or polyethyleneterephthalate immediately after the spinning thereof to a pre-orientation at a drawing off speed of more than 3,000 m/min. for the polyethyleneterephthalate filaments and 3,500 m/min. for the nylon 6,6, then cooling the drawn filaments, and plying and two-for-one twisting said filaments into cord yarns without further stretching, and subjecting said yarns to a residual stretching at a stretch ratio correlated with the drawing off speed so that the coordinates thereof fall within the shaded area on the graph of FIG. 9 (a) marked PES for the residual stretching of the polyethyleneterephthalate yarns and (b) marked PA 6.6 for the residual stretching of the nylon 6,6 yarns.

2. A process according to claim 1 in which the completely twisted cord yarns are fabricated into cord fabric or web of planar, parallel cord yarns prior to said residual stretching.

3. A process according to claim 1 wherein the residual stretching takes place with the application of heat to the yarns.

4. A process according to claim 3 wherein the residual stretching takes place at a temperature of 50° C to 130° C.

5. A process according to claim 1 wherein said filaments are nylon 6,6 filaments.

6. A process according to claim 1 wherein said filaments are polyethyleneterephthalate filaments.

7. A process according to claim 1 wherein the cord layer is subjected to heat fixing treatment after the residual stretching.

8. A process according to claim 7 wherein the heat fixing treatment and the residual stretching are carried out together in a continuous manner wherein the heat stabilizing treatment is operated continuously, and in combination with the residual stretching step.

9. A process as claimed in claim 1 wherein said plying and two-for-one twisting of said filaments is achieved by drawing said filaments off double-twist twisting spindles.

10. A process as claimed in claim 1 wherein said plying and two-for-one twisting of said filaments is achieved by drawing said filaments off double-twist twisting spindles, and said cord yarns are after-twisted, in a subsequent two-for-one twisting stage, by drawing said cord yarns off a double-twist, twisting spindle.

* * * * *